US006565341B2

(12) United States Patent
Bodzak

(10) Patent No.: US 6,565,341 B2
(45) Date of Patent: May 20, 2003

(54) GEARED FEED PUMP FOR SUPPLYING FUEL TO A HIGH PRESSURE FUEL PUMP

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/990,516

(22) Filed: Nov. 21, 2001

(65) Prior Publication Data

US 2002/0085940 A1 Jul. 4, 2002

(30) Foreign Application Priority Data

Nov. 23, 2000 (DE) ..... 100 58 012

(51) Int. Cl.[7] ..... F01C 17/00

(52) U.S. Cl. ..... 418/182; 418/179; 418/206.1; 418/206.9; 464/51; 464/30

(58) Field of Search ..... 418/206.1, 182, 418/206.9, 179; 464/51, 30

(56) References Cited

U.S. PATENT DOCUMENTS 1,687,523 A * 10/1928 Staude ..... 418/206.1
2,848,884 A * 8/1958 Maude ..... 464/30
6,050,795 A * 4/2000 Bodzak et al. ..... 418/206.1
6,425,749 B1 * 7/2002 Lettner et al. ..... 418/182

FOREIGN PATENT DOCUMENTS

DE 196 25 488 A1 1/1998
JP 10219307 A * 8/1998 ..... B22F/5/08

* cited by examiner

*Primary Examiner*—Thomas Denion
*Assistant Examiner*—Theresa Trieu
(74) *Attorney, Agent, or Firm*—Michael J. Striker

(57) ABSTRACT

A geared feed pump has a rotatably driven pair of meshed gears (16, 19) arranged in a pump chamber (14) of a housing (10, 12). The feed pump supplies fuel from a suction chamber (16) between the peripheries of the gears (16, 18) and the peripheral walls (15) of supply channels (30) formed in the pump chamber into a pressure chamber (28). One of the gears (16) has a hole (32) and is secured onto the drive shaft (22), which is rotatably positioned in the housing (10). At least one radially, resilient connecting element (40) is arranged on the drive shaft (22), and the connecting element is pressed into the hole (32) of the gear (16). The connecting element (40) makes possible the rotationally determined securement of the gear (16) onto the drive shaft (22) and forms an overload-protection device. The connecting element (40) also makes possible, through its radial resiliency, a tolerance equalization between the drive shaft (22) and the gear (16) in a radial direction.

7 Claims, 3 Drawing Sheets

GEARED FEED PUMP FOR SUPPLYING FUEL TO A HIGH PRESSURE FUEL PUMP

BACKGROUND OF THE INVENTION

The present invention relates generally to gear-type pumps. More particularly, the present invention relates to a geared feed pump for supplying fuel to a high-pressure fuel pump.

One type of geared feed pump is described in DE 196 25 488 A1. This geared feed pump has a rotary-powered pair of meshed gears arranged in a pump chamber of a housing. The feed pump feeds along fuel from a suction chamber between the perimeters of the gears and opposite-lying peripheral walls of the supply channels formed in the pump chamber into a pressure chamber. One of the gears is secured to a drive shaft, which is rotatably supported in the housing, by means of a hole. The drive shaft projects from the housing and there, is connected to a drive element via an overload-protection device. The overload-protection device has a radial, resilient connecting element, which is arranged on an end area of the drive shaft and pressed into a hole of the drive element. Through the connecting element, the torque transferable from the drive element onto the drive shaft is limited, in that upon exceeding the transferable torque, the drive element is rotatable relative to the drive shaft. In addition, through the connecting element, an equalization of manufacturing tolerance conditional offset and/or sloping position of the rotational axis of the drive element and the drive shaft is made possible. The gear secured on the drive shaft must be arranged with the least possible play for the oppositely lying peripheral wall of the pump chamber, in order to achieve a good efficiency of the geared feed pump. This is due to the rigid securement of the gear on the drive shaft, and whose positioning in the housing, as a result of the existing manufacturing tolerance, is difficult and is only obtainable with a very large expenditure. Moreover, a rigid connection of the gear with the drive shaft, for example, by a press-fit connection, is critical with a gear made from sinter metal, since with this construction, damage to the gear can occur.

SUMMARY OF THE INVENTION

In contrast with the above-described device, the geared feed pump of the present invention makes possible an equalization of the manufacturing tolerance of the positioning of the drive shaft and the arrangement of the gear connected to the drive shaft in the pump chamber by at least one connecting element, so that the gear can be arranged in the pump chamber with the required minimal play. In addition, the at least one connecting element forms an overload-protection device through which the torque transferable onto the gear is limited. It is also contemplated that the transferable torque can be increased.

The embodiments of the invention are illustrated in the drawings and described in more detail in the following description.

DETAILED DESCRIPTION OF THE PREFERRED EMBODIMENTS

Figure 1:
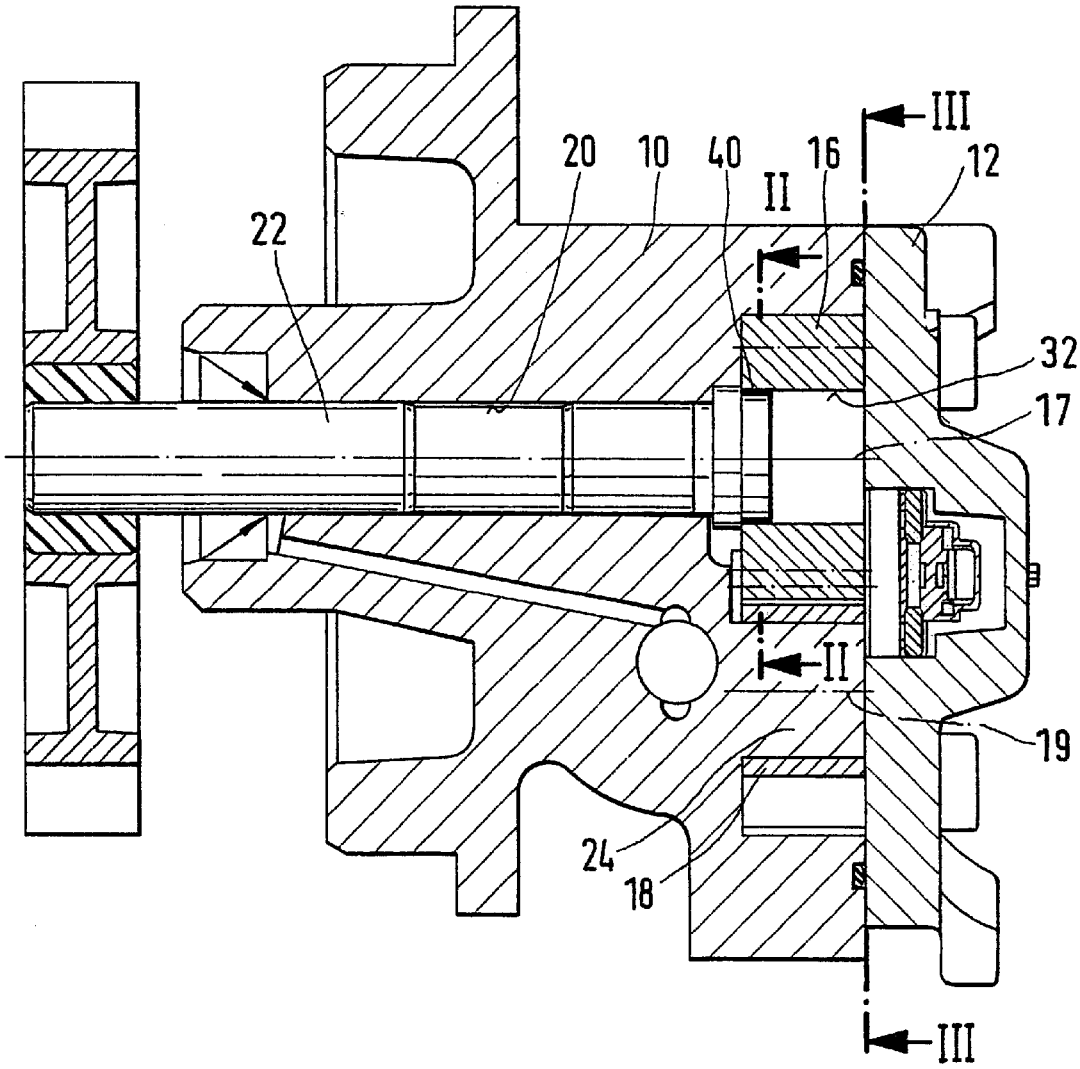
FIG. 1 shows the geared feed pump of the present invention in a longitudinal section.

The geared feed pump illustrated in FIGS. 1 through 5 serves to supply fuel from a storage tank to a high-pressure fuel pump. Through the high-pressure pump, fuel under high pressure is supplied to high-pressure storage or directly to injection sites on a combustion engine.

The geared feed pump comprises a two-part housing with a housing portion 10 and a cover portion 12. Between the housing portion 10 and the cover portion 12, a pump chamber 14 is formed, in which a pair of gears 16, 18, meshed to one another at their outer peripheries, is arranged. The housing portion 10 has a hole 20, in which a drive shaft 22 is rotationally supported, such that an end of the drive shaft 22 projects from the housing portion 10. This end is driven, for example, by a gear. Driving of the drive shaft 22 can be done, by way of example, by the high-pressure pump or the combustion engine.

The gear 16 is secured onto the end area of the drive shaft 22 projecting into the pump chamber 14 by at least one connecting element 40, which will be described in greater detail below, and is rotatably driven by the drive shaft 22 about an axis 17. The gear 18 is rotatably supported on a journal 24 projecting into the pump chamber 14 about an axis 197 whereby the rotational movement of the gear 16 is transferred onto the gear 18 by the gear engagement. The gears 16, 18, by their gear engagement, divide the pump chamber 14 into a suction chamber 26 and a pressure chamber 28. The pressure chamber 28 is connected with the suction chamber 26 via the peripheral sides of the gears 16, 18 between the gear grooves and the opposite-lying peripheral walls 15 of the supply channels 30 formed in the pump chamber. The suction chamber 26 is connected to a line leading to a storage container by a suction opening (not illustrated) and the pressure chamber 28 is connected to a line leading to the high-pressure pump by an outlet opening (also not illustrated). Upon operation of the geared feed pump, fuel under increased pressure is fed from The suction chamber 26 into the pressure chamber 28 by the rotating gears 16, 18.

The gear 16 has a hole 32 with which it is arranged onto the drive shaft 22. The drive shaft 22 has an annular groove 42 in its end area, in which the connecting element 40 is arranged. From the free end to the annular groove, an end portion 44 of the drive shaft 22 is attached or joined to the annular groove 42 and has a somewhat larger diameter than the end in the annular groove 42. On the side opposite to the end portion 44, a collar or flange 46 is joined with or connected to the annular groove 42, which compared to the annular groove and the end portion 44, is larger. The diameter of the end portion 44 of the drive shaft 22 is somewhat smaller than the diameter of the bore 32 of the gear 16. The connecting element 40 is radially, resiliently formed and, under flexible expansion, is shifted over the end portion 44 of the drive shaft 22 until it is introduced into the annular groove 42. The outer diameter of the connecting element 40 is somewhat larger than the diameter of the hole 32 of the gear 16. When the gear 16 is shifted onto the end portion 44 and the connecting element 40, the connecting element 40 is hereby flexibly or resiliently pressed together so that it provides a press-fit between the connecting element 40 and the drive shaft 22, as well as the connecting element 40 and the gear 16. Through this press-fit, the necessary torque can be transferred from the drive shaft 22 onto the gear 16. When the gear 16 or 18 squeezes into the pump chamber 14, the drive shaft 22 slips with reference to the gear 16 so that damage to parts of the geared feed pump are avoided. The connecting element 40 thus forms an overload-protection device.

Figure 2:
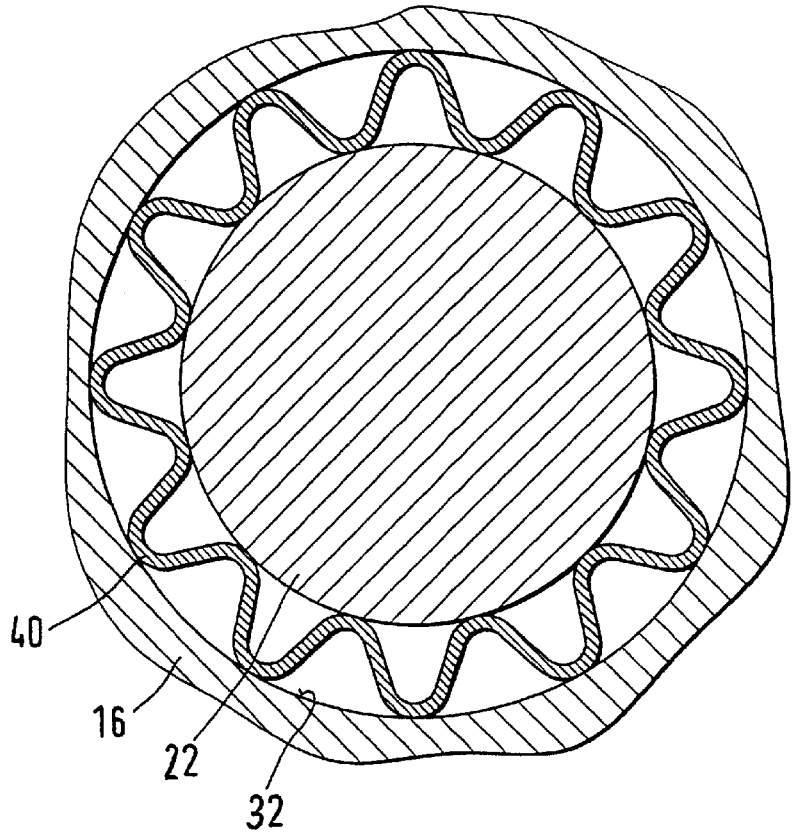
FIG. 2 shows the connecting element of the geared feed pump of the present invention in an enlarged viewed, in a cross-section taken along Lines II—II of FIG. 1.
Figure 3:
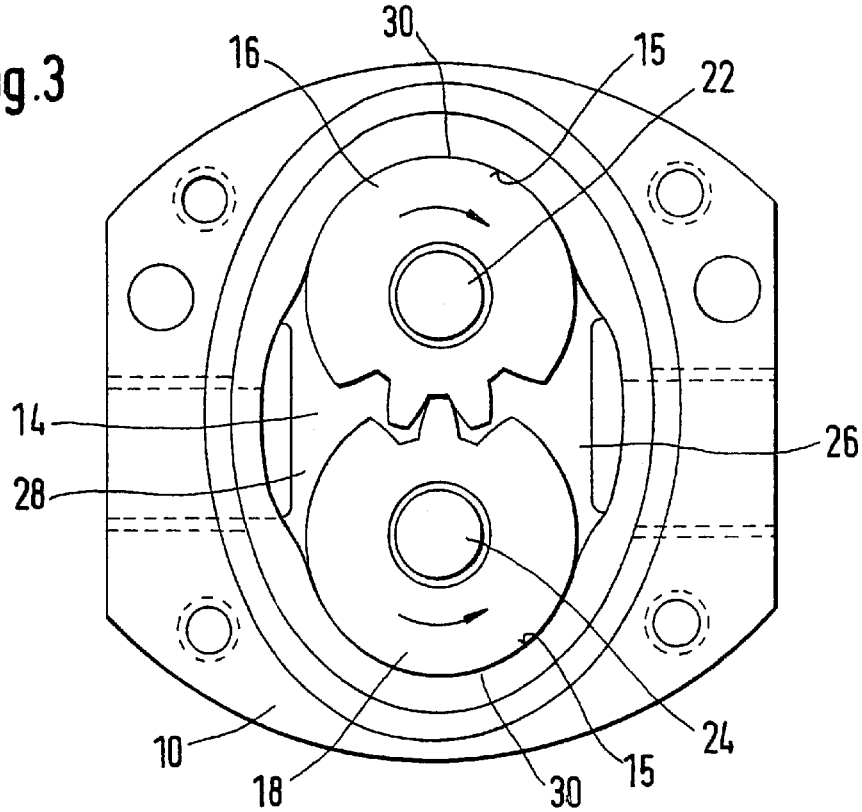
FIG. 3 shows the geared feed pump of the present invention, in a cross-section taken along Lines III—III of FIG. 1.
Figure 4:
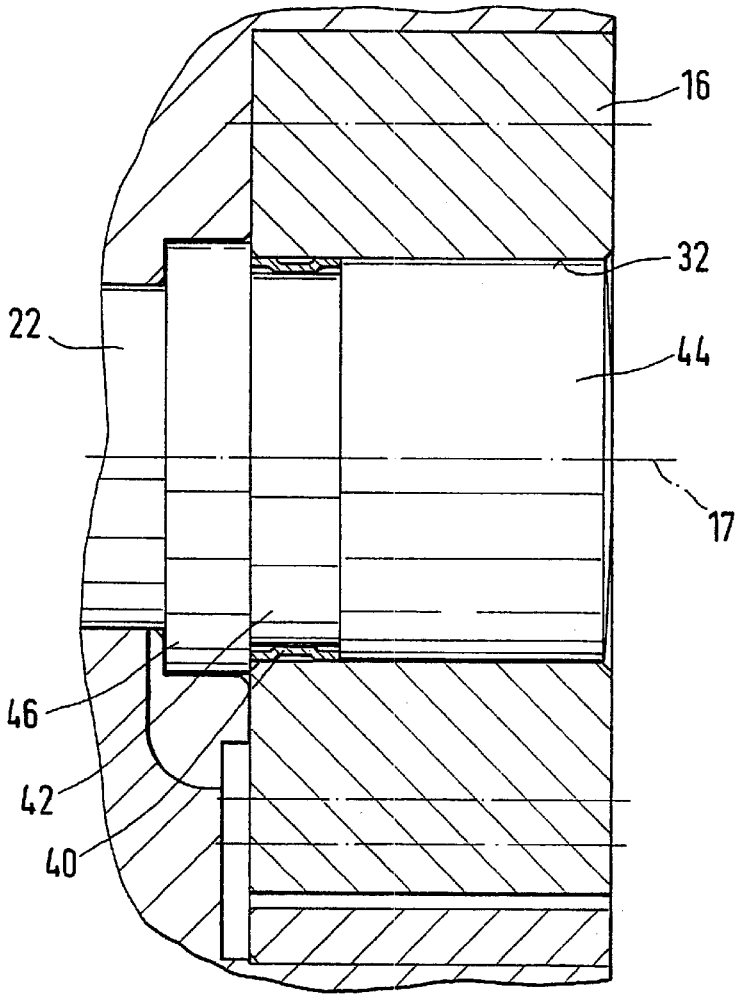
FIG. 4 shows, in a cutaway portion, the geared feed pump of the present invention in a longitudinal section with a modified connecting element.

The connecting element 40 is preferably formed as a corrugated metal sleeve, which has a corrugated or wavy profile over its periphery, as shown in FIG. 2. In FIG. 2, the corrugated profile of the connecting element 40 is exaggerated for the purposes of clarification. The wave troughs of the metal sleeve 40 abut the drive shaft 22 and the wave crests abut the hole 32 in the gear 16. When the gear 16 is shifted onto the metal sleeve 40, the wavy profile is radially pressed together, thereby providing the necessary press-fit connection. Alternatively, the connecting element 40, in longitudinal section, as shown in FIG. 4, can be somewhat U-shaped or arched, whereby the leg of the U-shape abuts the drive shaft 22 or into the hole 32 on the gear 16 and the area between the legs abut respectively on the other part, that is, in the bore 32 on the gear 16 or the drive shaft 22. Also, with this embodiment, the connecting element 40 is radially, resiliently deformable and is pressed together upon the pushing open of the gear 16, whereby the required press-fit is made. It also can be provided that the connecting element 40, in longitudinal section, has several, successive (or back-to-back) arches so that it is corrugated or wavy.

Between the end portion 44 of the drive shaft 22 and the hole 32 of the gear 16, radial play exists, and the torque transfer takes place only through the connecting element 40. The gear 16 is moveable in a radial direction to its rotational axis 17 relative to the drive shaft 22 through flexible deformation of the connecting element 40, whereby a balance of shape and position fluctuation is made possible between the drive shaft 22, the gear 16, and the pump chamber 14. In this manner, the gear 16 can position itself in the pump chamber 14 with the necessarily small play to the adjacent peripheral wall 15 of the pump chamber 14.

Figure 5:
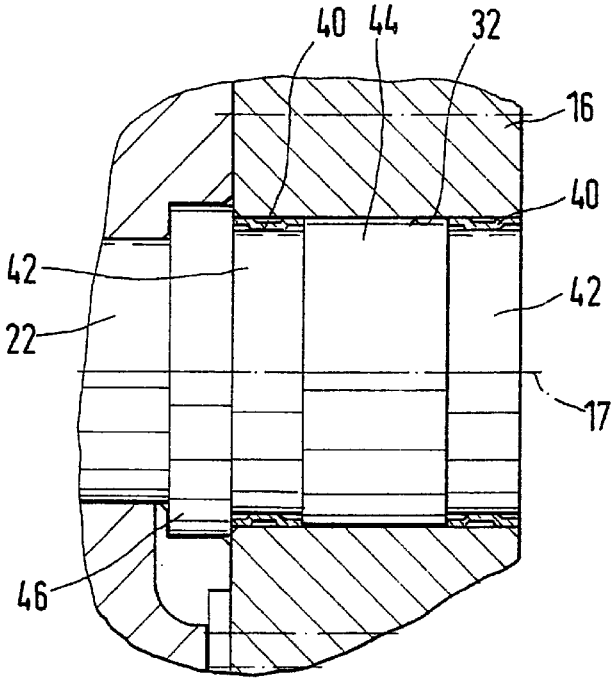
FIG. 5 shows, in a cutaway portion, the geared feed pump according to an embodiment with two connecting elements.

The level of the pressing between the connecting element 40 and the drive shaft 22, as well as between the connecting element 40 and the gear 16, determines, together with the frictional coefficient between these pads, the level of the transferred torque. The level of the pressing is again dependent on the difference between the outer diameter of the connecting element 40 and the diameter of the bore 32 of the gear 16. In order to increase the torque, it can be provided that two or more connecting elements 40 are used, as shown in FIG. 5, which are arranged to be offset to one another in the direction of the rotational axis 17 of the gear 16, which also is the longitudinal axis of the drive shaft 22. The drive shaft 22 thus correspondingly has two or more annular grooves 42, in which a respective connecting element 40 is disposed.

The gear 16 can be made of steal or sinter metal, for example, sinter steel. The gear 16 is not secured directly onto the drive shaft 22 by means of a press-fit connection, rather through at least one connecting element 40, through whose radial, elastic deformability, an equalization of the tolerance between the gear 16 and the drive shaft 22, and also an equalization of various thermal expansions of the gear 16 and the drive shaft 22, are made possible. In this manner, inordinate amounts of strain on the gear 16 are avoided, which can lead to damage to the gear 16.

It will be understood that each of the elements described above, or two or more together, may also find a useful application in other types of constructions differing from the types described above.

While the invention has been illustrated and described herein as a geared feed pump for supplying fuel to a high-pressure fuel pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A geared feed pump for supplying fuel to a high-pressure pump, comprising:

two rotatably driven meshed gears (16, 18), said gears arranged in a pump chamber (14) of a housing (10, 12), wherein the fuel is fed from a suction chamber (26) between peripheries of said gears (16, 18) and peripheral walls (15) of supply channels (30) formed in said pump chambers (14) into a pressure chamber (28), wherein one of said gears (16) has a hole (32) and is secured to a drive shaft (22) rotatably positioned in said housing (10), wherein at least one, radially resilient connecting element (40) is disposed on the drive shaft (22) wherein said connecting element (40) is pressed into said holes (32) in said gears (16), and wherein said at least one connecting element (40) is a corrugated sheet metal sleeve.

2. The geared feed pump as defined in claim 1, wherein said at least one connecting element (40) is a sleeve, wherein said sleeve is corrugated in a longitudinal section and is made of metal.

3. The geared feed pump as defined in claim 1, wherein a plurality of connecting elements (40) are provided, said connecting elements (40) arranged off-set to one another in a direction of a longitudinal axis (17) of said drive shaft (22).

4. The geared feed pump as defined in claim 1, wherein the drive shaft (22) has at least one annular groove (42).

5. The geared feed pump as defined in claim 4, wherein said at least one connecting element (40) is arranged in said at least one annular groove (42).

6. The geared feed pump as defined in claim 1, wherein one of said gears (16) is made of a sinter metal.

7. The geared feed pump as defined in claim 6, wherein said sinter metal is sinter steel.

* * * * *